US007568928B2

(12) United States Patent
Hou et al.

(10) Patent No.: US 7,568,928 B2
(45) Date of Patent: Aug. 4, 2009

(54) CARD CONNECTOR AND CARD CONNECTOR ASSEMBLY

(75) Inventors: Pin-Yuan Hou, Hsin-Tien (TW); Yao-Te Wang, Hsin-Tien (TW); Wen-Chih Ko, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/171,409

(22) Filed: Jul. 11, 2008

(65) Prior Publication Data

US 2009/0023319 A1 Jan. 22, 2009

(30) Foreign Application Priority Data

Jul. 20, 2007 (TW) ..... 96211894 U

(51) Int. Cl.
*H01R 29/00* (2006.01)

(52) U.S. Cl. ..... 439/188; 439/630

(58) Field of Classification Search ..... 439/188, 439/189, 630, 79, 83; 235/441; 200/51.1, 200/51.09

See application file for complete search history.

(56) References Cited

U.S. PATENT DOCUMENTS 6,425,775 B1 * 7/2002 Chang et al. ..... 439/188

* cited by examiner

*Primary Examiner*—Javaid Nasri
(74) *Attorney, Agent, or Firm*—patenttm.us

(57) ABSTRACT

A card connector is mounted on a PCB and has an insulative housing, a plurality of terminals, a pair of hook assemblies and a tray. The terminals are mounted on the insulative housing. The hook assemblies are mounted on the insulative housing and each hook assembly has a hook and a sheath. The sheath covers the hook. The tray is mounted slidably on the insulative housing and has two slides and two positioning notches defined respectively in the slides and selectively engaged respectively with sheathes on the hooks. The sheathes prevent the hooks from wearing the tray and prevent the slides from deviating.

7 Claims, 9 Drawing Sheets

CARD CONNECTOR AND CARD CONNECTOR ASSEMBLY

BACKGROUND OF THE INVENTION

1. Field of the Invention

The present invention relates to a connector, and more particularly to a card connector that is mounted on a printed circuit board, has hooks and a tray and prevents the hooks from wearing the tray.

2. Description of Related Art

With reference to FIG. 7, a conventional card connector (1) is mounted on a printed circuit board (PCB) (P) and has an insulative housing (6*a*), a plurality of terminals (4*a*), a bracket (3*a*), two hooks (7*a*), a cover (8*a*) and a tray (9*a*). The PCB (P) has positioning holes (h) and a circuit (W).

The insulative housing (6*a*) has two sides and two rail slots (630, 640). The rail slots (630, 640) are longitudinally defined respectively in the sides. The terminals (4*a*) are mounted in the insulative housing (6*a*). The bracket (3*a*) has a plurality of positioning holes to respectively position the terminals in the insulative housing (6*a*). The hooks (7*a*) are made of stainless steel and are mounted on the insulative housing (6*a*). The cover (8*a*) is mounted on the insulative housing and holds the hooks (7*a*). The tray (9*a*) is made of aluminum, is mounted slidably on the insulative housing (6*a*) and has two slides (931, 941). The slides (931, 941) are slidably mounted respectively in the rail slots (630, 640).

However, the stainless steel hooks (7*a*) easily wear the slides (931, 941) of the aluminum tray (9*a*). Furthermore, the slides (931, 941) are easily misaligned with the hooks (7*a*) to deviate from the rail slots (630, 640) and are jammed between the rail slots (630, 640) and the hooks (7*a*).

To overcome the shortcomings, the present invention provides a card connector to mitigate or obviate the aforementioned problems.

SUMMARY OF THE INVENTION

The main objective of the invention is to provide a card connector that is mounted on a printed circuit board, has hooks and a tray and prevents the hooks from wearing the tray.

A card connector in accordance with the present invention is mounted on a PCB and comprises an insulative housing, a plurality of terminals, a pair of hook assemblies and a tray. The terminals are mounted on the insulative housing The hook assemblies are mounted on the insulative housing and each hook assembly has a hook and a sheath. The sheath covers the hook. The tray is mounted slidably on the insulative housing and has two slides and two positioning notches defined respectively in the slides and selectively engaged respectively with sheathes on the hooks.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
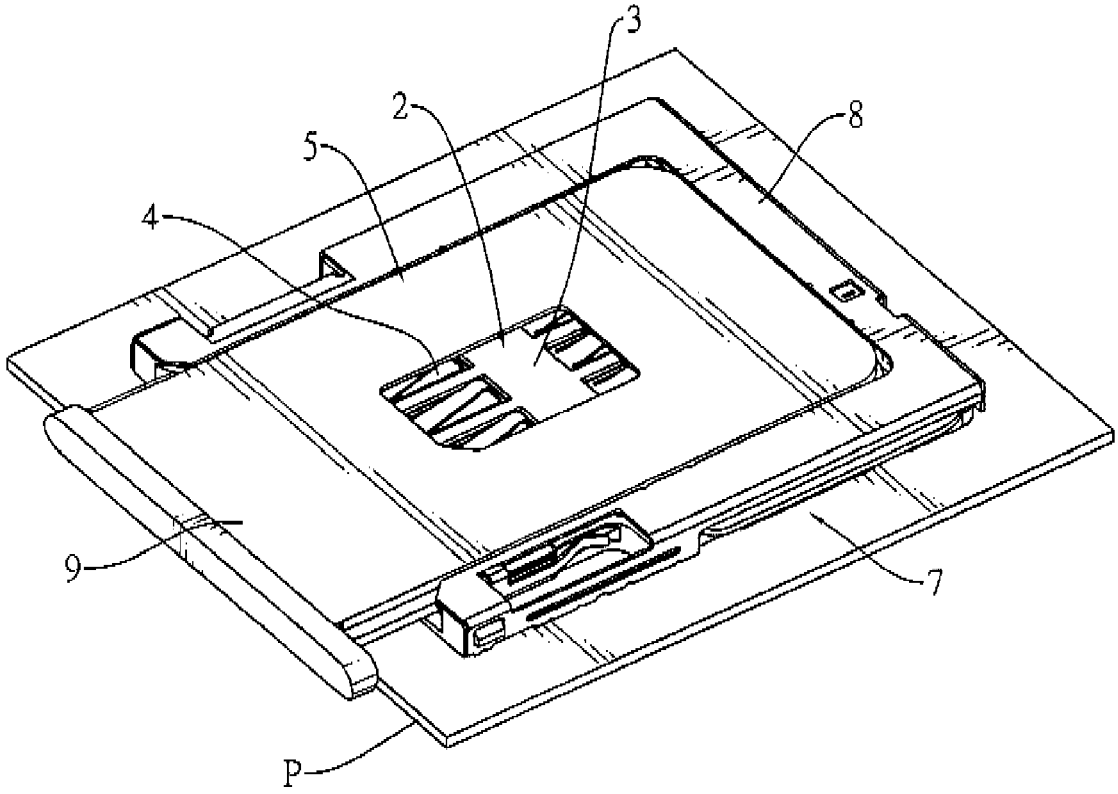
FIG. 1 is a top perspective view of a card connector assembly in accordance with the present invention having a card connector and a printed circuit board (PCB)
Figure 2:
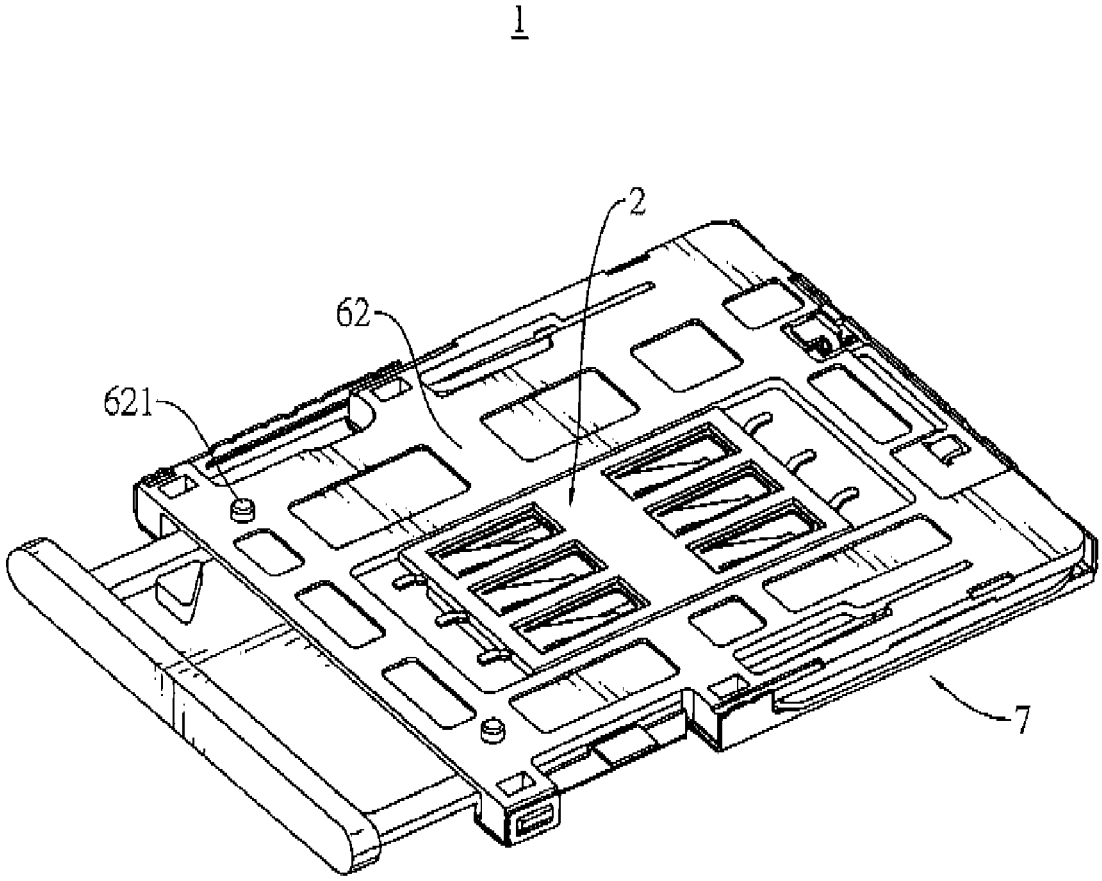
FIG. 2 is an operational bottom perspective view of the card connector assembly in FIG. 1.
Figure 3A:
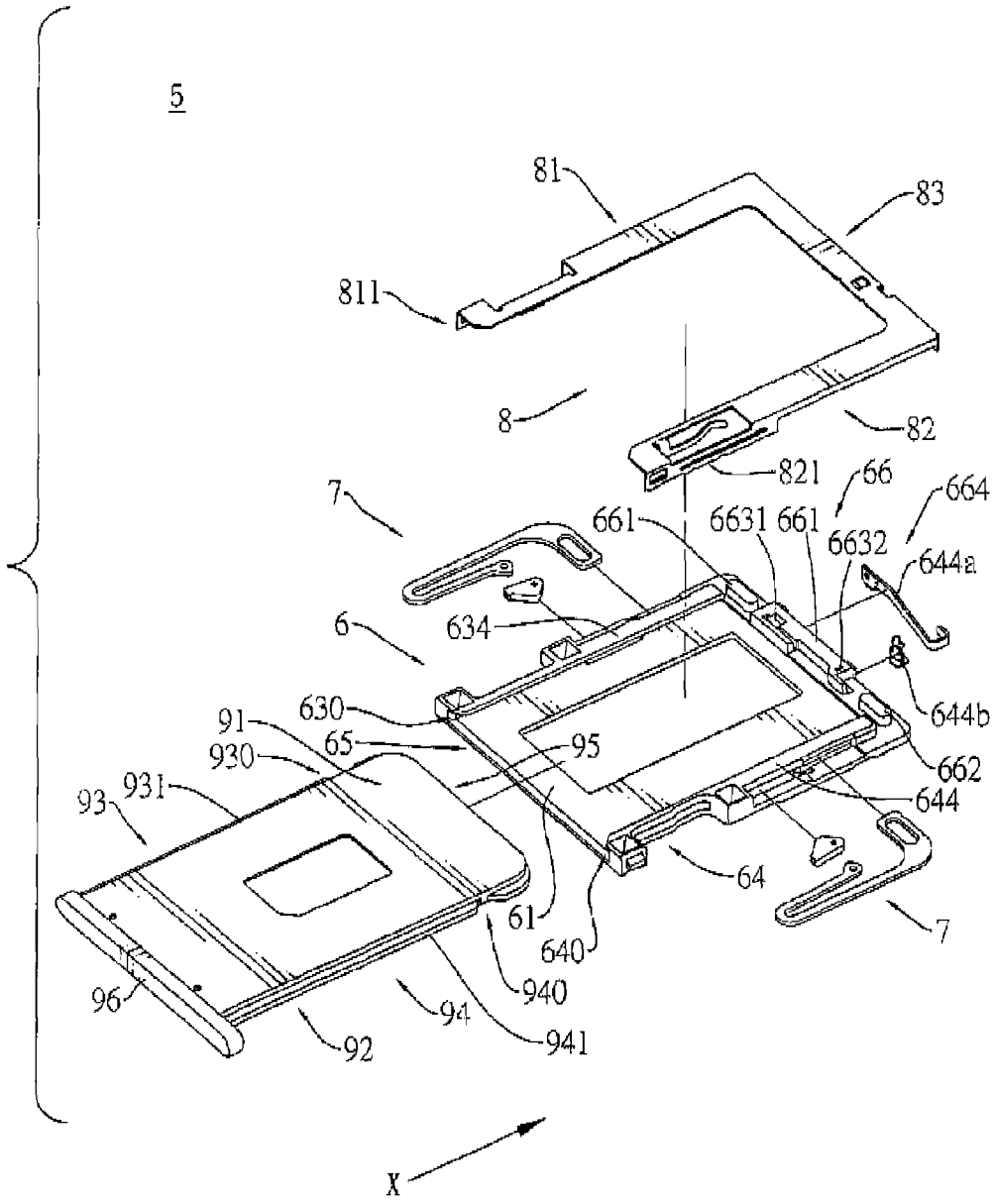
FIG. 3A is an exploded perspective view of the card connector in FIG. 1 without the bracket and the terminals.
Figure 3B:
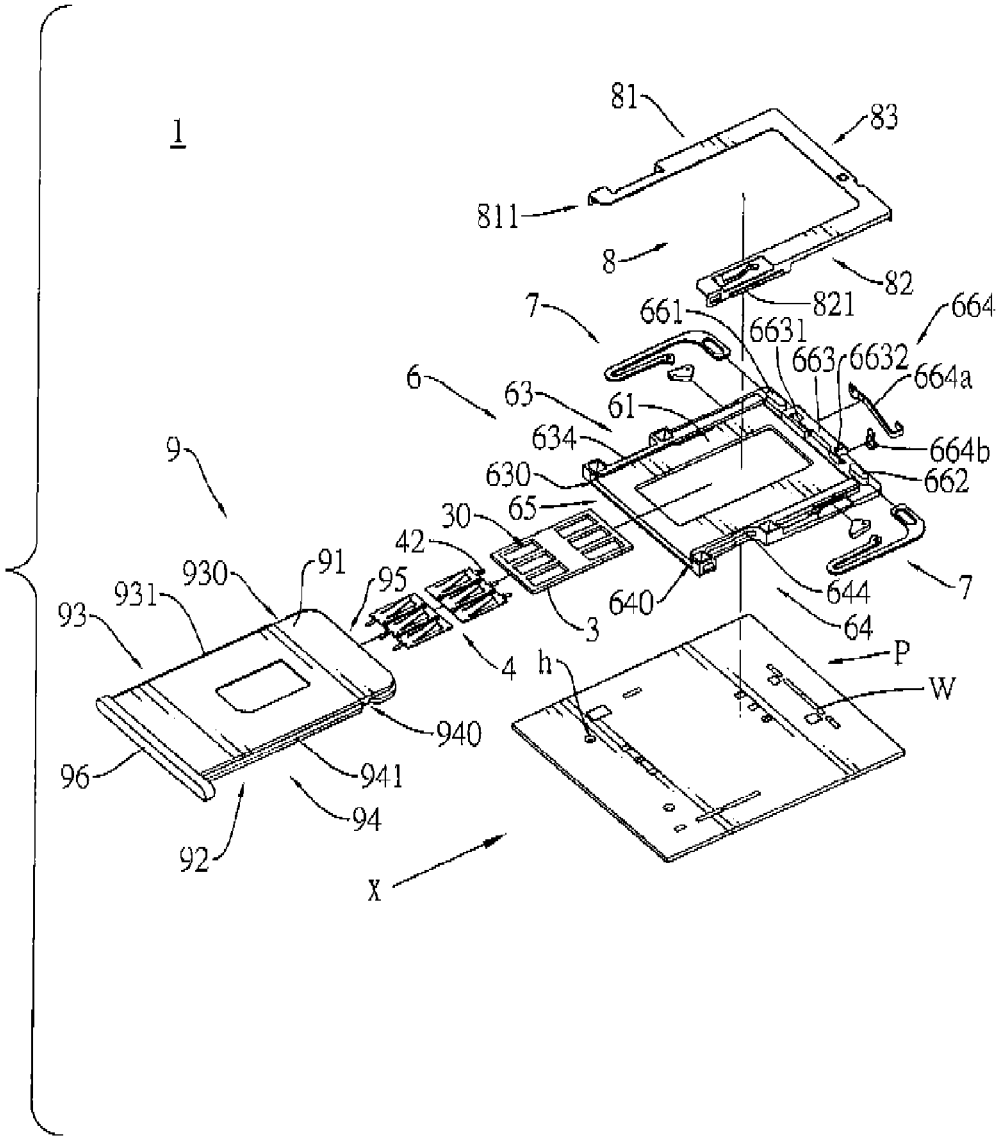
FIG. 3B is an exploded perspective view of the card connector assembly in FIG. 1.
Figure 4:
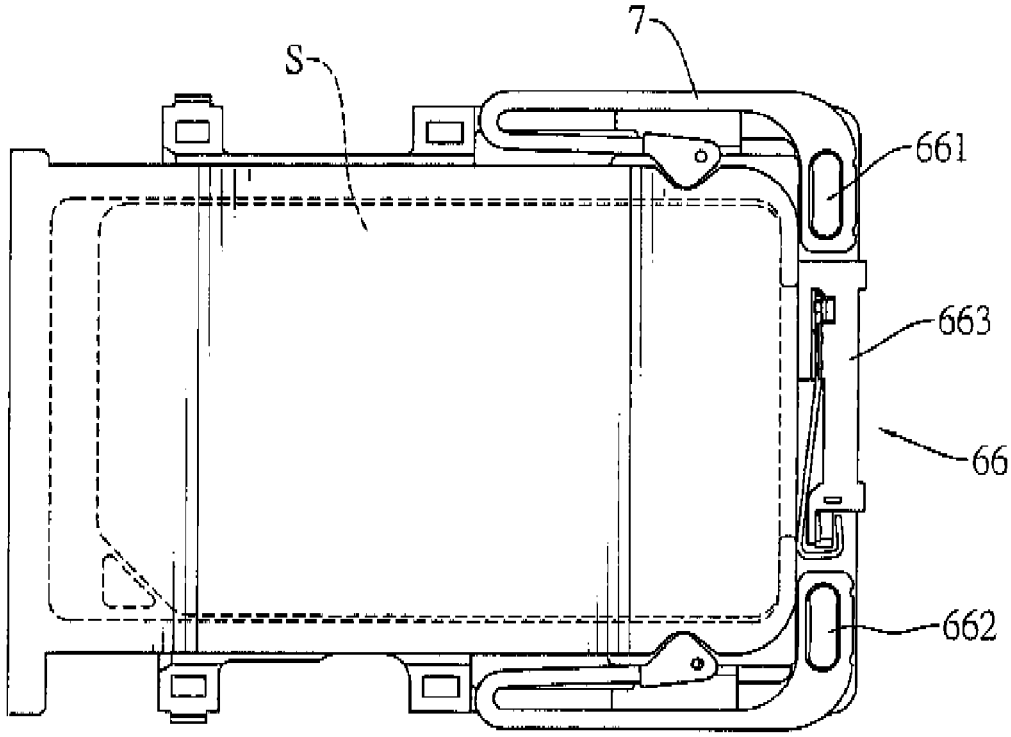
FIG. 4 is a top view of the card connector in FIG. 1.

With reference to FIGS. 1, 2, 3A, 3B and 4, a card connector assembly (5) in accordance with the present invention comprises a printed circuit board (PCB) (P) and a card connector.

The PCB (P) has a circuit (W) and positioning holes (h).

The card connector is mounted on a printed circuit board (PCB) (P) and may receive a card (S). The card (S) may be a Subscriber Identity Module (SIM) card and has contacts. The arrow (X) in FIG. 3B points to the front of the card connector. The card connector comprises an insulative housing (6), a plurality of terminals (4), a bracket (3), a pair of hook assemblies (7), a cover (8) and a tray (9).

The insulative housing (6) is rectangular, is mounted on the PCB (P) and has an open top (61), a bottom (62), two opposite sidewalls (63, 64), an open front end (65), a rear end (66), a space, an opening, two rail tabs (634, 644) and two rail slots (630, 640) and may further have two hook mounts (661), a block (663) and a switch.

The space is defined in the insulative housing (6) and communicates with the open top (61) and open front end (65).

The opening is defined through the bottom (62).

The rail tabs (634, 644) are formed respectively on and protrude transversely inwards from the sidewalls (63, 64).

The rail slots (630, 640) are longitudinally defined respectively in the sidewalls (63, 64) under the rail tabs (634, 644) and communicate with the space.

The hook mounts (661, 662) are formed on and protrude up from the rear end (66).

The block (663) is formed on and protrudes up from the rear end (66), may be between the hook mounts (661, 662) and has a first mounting slot (6631) and a second mounting slot (6632). The first mounting slot (663 1) is defined in the block (663). The second mounting slot (6632) is defined in the block (663).

The switch is mounted on the block (663), is connected to the circuit (W) of the PCB (P) and has a stationary contact (664*b*) and a movable contact (664*a*). The stationary contact (664*b*) is mounted in the second mounting slot (6632). The movable contact (664*a*) is resilient and longitudinal, is mounted in the first mounting hole (6631) and selectively contacts the stationary contact (664*b*) to activate the circuit (W) of the PCB (P).

The terminals (4) are mounted in the opening in the bottom (62) of the insulative housing (6), are soldered on the PCB (P) and each terminal (4) has a contacting section (41) and a soldering section (42). The contacting section (41) is resilient and may contact one contact on the card (S). The soldering section (42) is formed on the contacting section (41) and is soldered on the PCB (P).

The bracket (3) is mounted in the opening of the insulative housing (6), presses against and holds the terminals (4) and has a plurality of positioning slots (30). The positioning slots (30) are defined through the bracket (3) and allows the contacting sections (41) of the terminals (4) to extend respectively through the positioning slots (30).

Figure 5A:
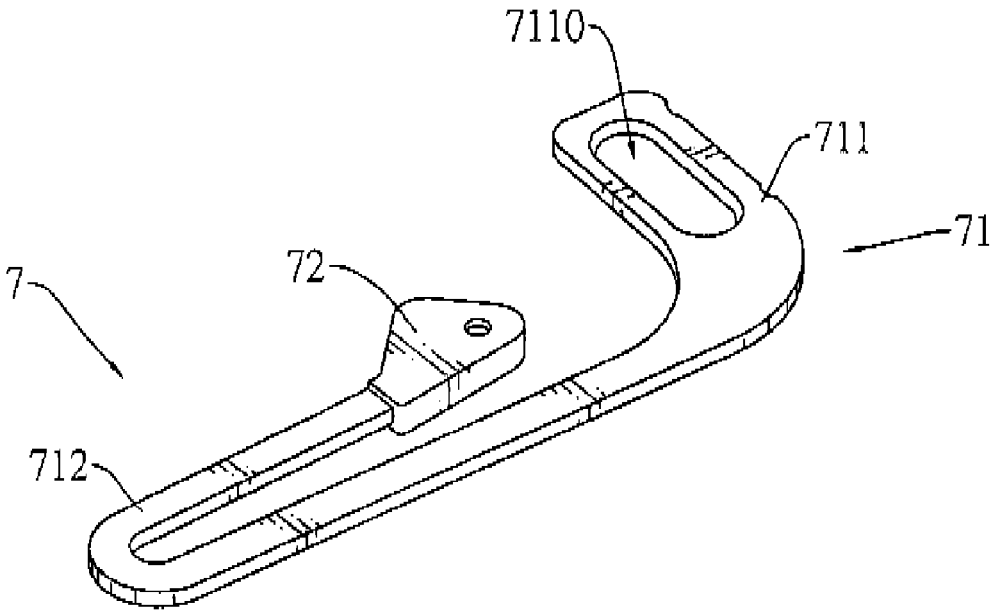
FIG. 5A is an enlarged top perspective view of the hook assembly of the card connector assembly in FIG. 3A.
Figure 5B:
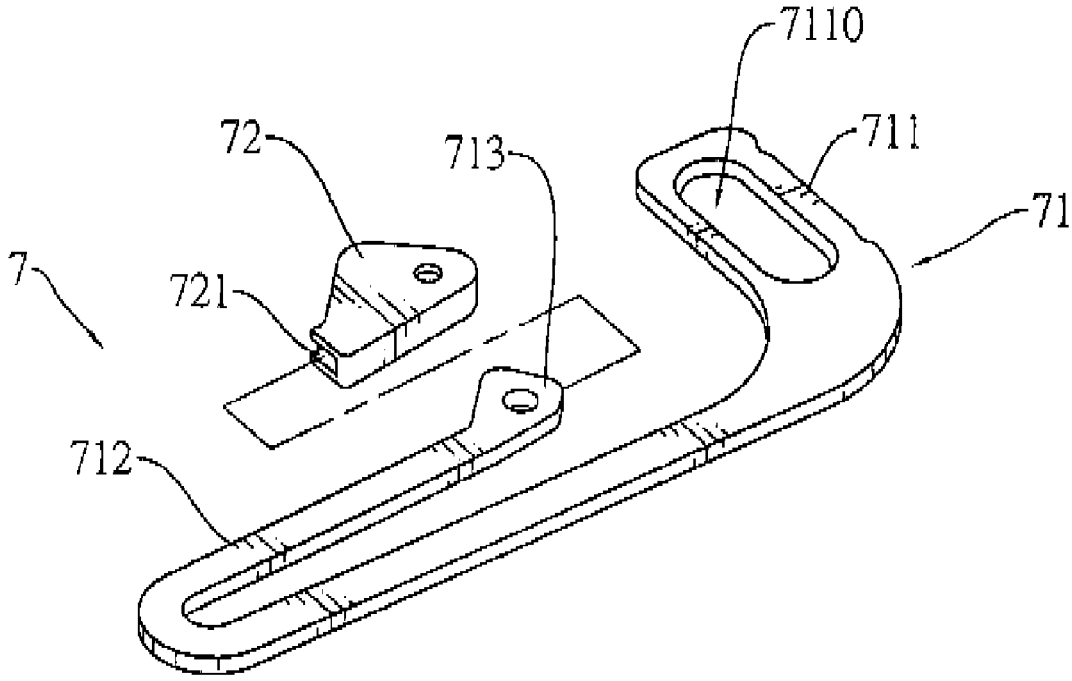
FIG. 5B an enlarged and exploded top perspective view of the hook assembly of the card connector assembly in FIG. 5A.

With further reference FIGS. 5A and 5B, the hook assemblies (7) are mounted on the insulative housing (6) adjacent respectively to the sidewalls (63,64) and each hook assembly (7) has a hook (71) and a sheath (72), The hook (71) is made of stainless steel, is mounted on the insulative housing and has a mounting portion (711), a resilient portion (712) and a hooking portion (713). The mounting portion (711) is mounted on the rear end of the insulative housing (66) and has a mounting bore (7110) defined through the mounting portion (711) and mounted around one of the hook mounts (661, 662). The resilient portion (712) is U-shaped and is formed on and protrudes perpendicularly from the mounting portion (711). The hooking portion (713) is angled and is formed on and protrudes from the resilient portion (712).

The sheath (72) is angled, is made of nonmetal such as plastic, fully covers the hooking portion (713) of the hook (71) by an over molding process and has hardness and a fitting hole (721). The fitting hole (721) is defined in the sheath (72) and is mounted around the hooking portion (713).

The cover (8) is U-shaped, is formed from a sheet metal by a stamping process, may be made of bronze, is mounted on the insulative housing (6) and covers the sidewalls (63, 64) and the hook assemblies (7) and has two side sections (81, 82) and an intermediate section (83).

The side sections (81. 82) respectively cover the sidewalls (63, 64) of the insulative housing (6) and the hook assemblies (7) and each side section (81, 82) 8 has a soldering tab (811, 812) soldered on the PCB (P) to hold the insulative housing (6) on the PCB (P).

The intermediate portion (83) is formed between the side sections (81, 82) and covers the rear end (66) and the block (663) of the insulative housing (6).

Figure 6:
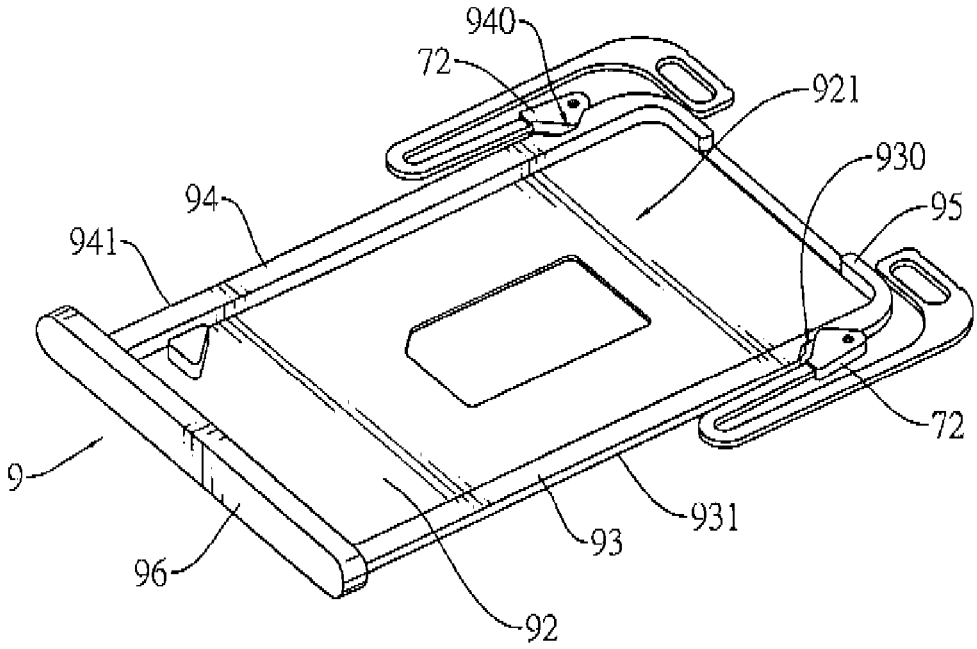
FIG. 6 is a bottom perspective view of the tray and the hook assemblies of the card connector assembly in FIG. 5A.
Figure 7:
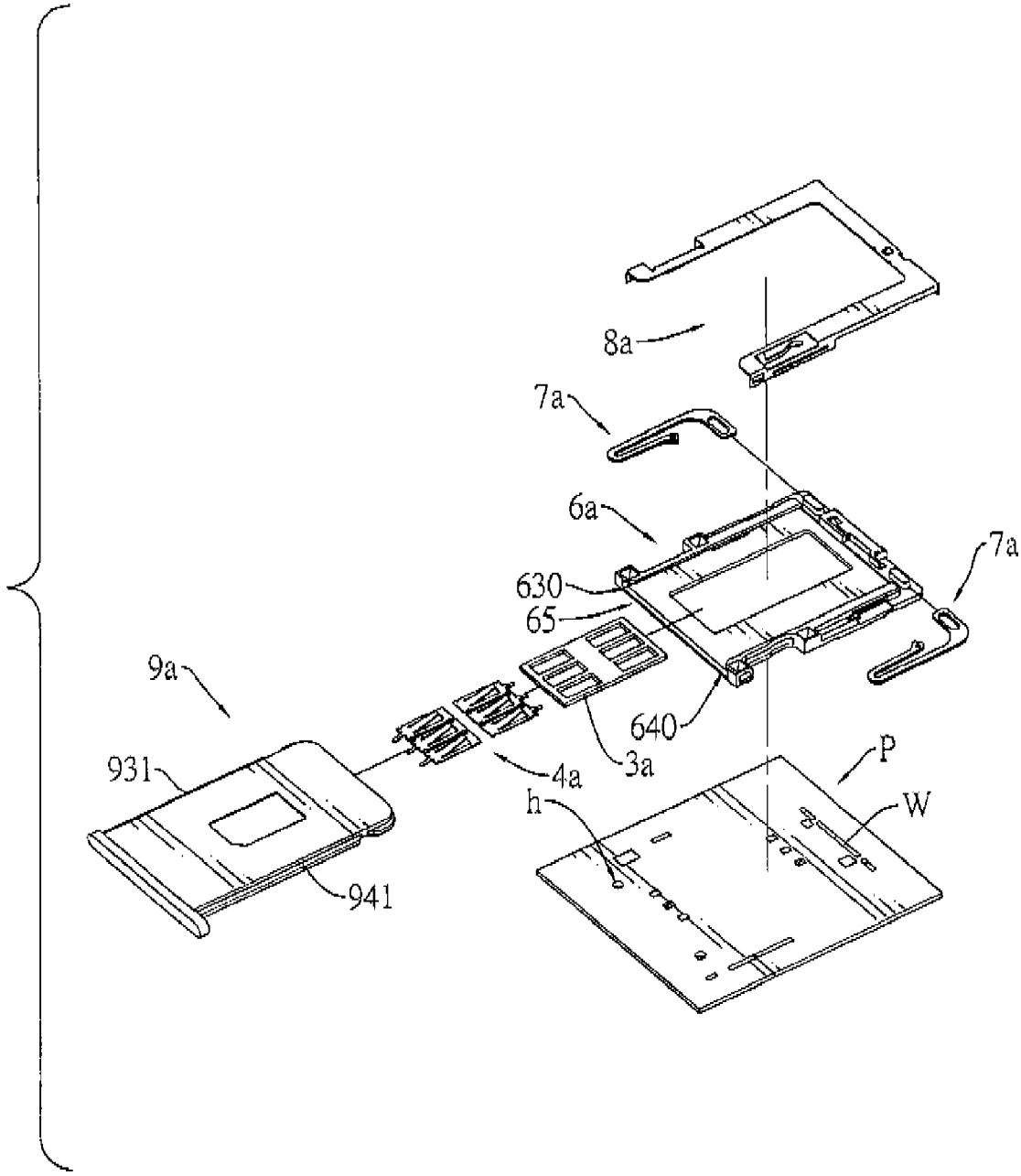
FIG.7 PRIOR ART
FIG. 7 is an exploded perspective view of a conventional card connector in accordance with the prior art mounted on a PCB.

With further reference to FIG. 6, the tray (9) is made of metal such as aluminum, is detachably mounted slidably in the space of the insulative housing (6), selectively abuts against the block (663), selectively presses against and bends the movable contact (664*a*) to contact the stationary contact (664*b*) and may receive and carry the card (S). The tray (9) has hardness, a top (91), an open bottom (92), two opposite sides (931, 941), a cavity (921), two slides (931, 941) and two positioning notches (930, 940). The hardness of the tray (9) is higher than that of the sheath (72).

The cavity (921) is defined in the tray (9), communicates with open bottom (92) and may receive the card (S).

The slides (931, 941) are longitidinal, are formed respectively on the sides (93) and are slidably mounted respectively in the rail slots (630, 640) of the insulative housing (6).

The positioning notches (930, 940) are triangular, are transversely defined respectively in the slides (931, 941) and are selectively engaged respectively with the sheathes (72) on the hooks (71) to lock the tray (9) in the insulative housing (6).

The sheath (72) on the hook (71) is made of nonmetal such as plastic and has the hardness less than that of the tray (9) made of aluminum. Therefore, the sheath (72) prevents the hooking portion (713) on the hook (71) from wearing the slides (931, 941) of the tray (9).

Furthermore, the hooking portion (713) of the hook (71) with the sheath (72) has a sufficient thickness larger than that of the slide (931, 941) on the tray (9). Therefore, the slide (931, 941) is aligned stably with and slides steadily on the hooking portion (71) with the sheath (72) to prevent the slide (931, 941) from deviating and jamming.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terns in which the appended claims are expressed.

What is claimed is:

1. A card connector comprising:

an insulative housing having an open top;

a bottom;

two opposite sidewalls;

an open front end;

a rear end;

a space defined in the insulative housing and communicating with the open top and open front end;

an opening defined through the bottom; and two rail slots defined respectively in the sidewalls and communicating with the space;

a plurality of terminals mounted in the opening in the bottom;

a pair of hook assemblies mounted on the insulative housing adjacent respectively to the sidewalls and each hook assembly having a hook mounted on the insulative housing and having a mounting portion mounted on the rear end of the insulative housing;

a resilient portion being U-shaped and formed on and protruding perpendicularly from the mounting portion; and a hooking portion being angled and formed on and protruding from the resilient portion; and a sheath being angled, covering the hooking portion of the hook and having hardness;

a cover being U-shaped, mounted on the insulative housing, covering the hook assemblies and having two side sections and an intermediate section formed between the side sections; and a tray detachably mounted slidably in the space of the insulative housing and having hardness being higher than that of said each sheath;

an open bottom;

two opposite sides;

a cavity defined in the tray and communicating with the open top;

two slides being longitudinal, formed respectively on the sides and slidably mounted respectively in the rail slots of the insulative housing; and two positioning notches transversely defined respectively in the slides and selectively engaged respectively with the sheathes on the hooks.

2. The card connector as claimed in claim 1, wherein each sheath is made of nonmetal.

3. The card connector as claimed in claim 2, wherein each sheath is made of plastic.

4. The card connector as claimed in claim 3, wherein each hook is made of stainless steel.

5. The card connector as claimed in claim 4, wherein the tray is made of aluminum.

6. The card connector as claim in claim 5, wherein the insulative housing further has two hook mounts formed on and protruding up from the rear end of the insulative housing; and a block formed on and protruding up from the rear end between the hook mounts of the insulative housing;

the mounting portion of each hook has a mounting bore defined through the mounting portion and mounted around one of the hook mount; and the tray selectively abuts against the block.

7. A card connector assembly comprising:

a printed circuit board (PCB);

a card connector mounted on the PCB and having an insulative housing mounted on the PCB and having an open top;

a bottom;

two opposite sidewalls;

an open front end;

a rear end;

a space defined in the insulative housing and communicating with the open top and open front end;

an opening defined through the bottom; and two rail slots defined respectively in the sidewalls and communicating with the space;

a plurality of terminals mounted in the opening in the bottom and are soldered on the PCB;

a bracket mounted in the opening in the bottom of the insulative housing, holding the terminals and having a plurality of positioning slots defined through the bracket and through which the terminal extend respectively;

a pair of hook assemblies mounted on the insulative housing adjacent respectively to the sidewalls and each hook assembly having a hook mounted on the insulative housing and having a mounting portion mounted on the rear end of the insulative housing;

a resilient portion being U-shaped and formed on and protruding perpendicularly from the mounting portion; and a hooking portion being angled and formed on and protruding from the resilient portion; and a sheath being angled, covering the hooking portion of the hook and having hardness;

a cover being U-shaped, mounted on the insulative housing, covering the hook assemblies and having two side sections soldered on the PCB to hold the insulative housing on the PCB; and an intermediate section formed between the side sections; and a tray detachably mounted slidably in the space of the insulative housing and having hardness being higher than that of said each sheath;

an open bottom;

two opposite sides;

a cavity defined in the tray and communicating with the open top;

two slides being longitudinal, formed respectively on the sides and slidably mounted respectively in the rail slots of the insulative housing; and two positioning notches transversely defined respectively in the slides and selectively engaged respectively with the sheathes on the hooks.

* * * * *